US005262604A

United States Patent [19]

Powell

[11] Patent Number: 5,262,604

[45] Date of Patent: Nov. 16, 1993

[54] FLOAT LEVEL SWITCH FOR A NUCLEAR POWER PLANT CONTAINMENT VESSEL

[75] Inventor: James G. Powell, Clifton Park, N.Y.

[73] Assignee: The United States of America as represented by the United States Department of Energy, Washington, D.C.

[21] Appl. No.: 681,030

[22] Filed: Apr. 5, 1991

[51] Int. Cl.[5] ..... H01H 36/00; H01H 35/18

[52] U.S. Cl. ..... 200/84 C; 335/206

[58] Field of Search ..... 200/84 C; 340/623, 624; 335/205, 153

[56] References Cited

U.S. PATENT DOCUMENTS 4,213,110 7/1980 Holce ..... 335/153

4,329,550 5/1982 Verley ..... 200/84 C 4,833,441 5/1989 Okada et al. ..... 340/624

*Primary Examiner*—Harold Broome

*Attorney, Agent, or Firm*—Frederick C. Williams; William R. Moser; Richard E. Constant

[57] ABSTRACT

This invention is a float level switch used to sense rise or drop in water level in a containment vessel of a nuclear power plant during a loss of coolant accident. The essential components of the device are a guide tube, a reed switch inside the guide tube, a float containing a magnetic portion that activates a reed switch, and metal-sheathed, ceramic-insulated conductors connecting the reed switch to a monitoring system outside the containment vessel. Special materials and special sealing techniques prevent failure of components and allow the float level switch to be connected to a monitoring system outside the containment vessel.

5 Claims, 1 Drawing Sheet

FLOAT LEVEL SWITCH FOR A NUCLEAR POWER PLANT CONTAINMENT VESSEL

CONTRACTUAL ORIGIN

The present invention was conceived and developed in the performance of United States Government Contract DE-AC12-76-SN00052 with the Department of Energy. The U.S. Government has certain rights to this invention.

FIELD OF THE INVENTION

The present invention relates generally to a warning device that senses liquid level under conditions of high temperature, high pressure, chemicals, and high radiation. Specifically, special materials and sealing techniques allow a float level switch to be used in a nuclear power plant containment vessel to detect liquid level during a loss of coolant accident.

DESCRIPTION OF THE PRIOR ART

During a loss of coolant accident, it is important to be able to monitor the level of water in a containment vessel that surrounds a nuclear reactor. In the reactor, a core of nuclear fuel is cooled by a recirculating primary coolant, most often water. Primary coolant becomes contaminated and radioactive and therefore, must not be released to the environment. The heat taken up by the primary coolant is transferred to a secondary coolant by means of a steam generator. The steam from the steam generator is used to drive a turbine generator and generate electricity.

In a loss of coolant accident, primary coolant leaks in the form of superheated steam and later condenses into the containment vessel where it is held for recirculation back through the reactor and them for treatment and disposal. In a naval nuclear power plant, the containment vessel is the hull of a nuclear submarine. In a commercial nuclear power plant, it is a large structure that surrounds the reactor.

During a loss of coolant accident, various actions are taken to shut down the nuclear reactor. Neutron-absorbing substances are inserted into the reactor core to stop the chain reaction. Meanwhile, water from the Emergency Core Cooling System is pumped into the reactor to prevent or mimimize damage to the fuel that would be caused by very high temperatures. Fuel damage would result in release of fission products to the primary coolant and then to the containment vessel. This could result in extremely high radiation levels in the containment vessel. The water level in the containment vessel must be monitored because the containment vessel has a limited capacity, and additional emergency action must be taken as its capacity is approached. In addition, a minimum level must be achieved before this water can be recirculated back to the reactor.

Currently, any commercially available float level switch is almost certain to fail after even a brief exposure to the conditions of high temperature (about 520 deg. F), high pressure (160 psig), and high radiation (365,000,000 rads) that can occur in the containment vessel of a naval nuclear power plant. And though somewhat milder conditions would occur in a commercial nuclear power plant, nonetheless, failure of the float switch is likely there too.

Possible modes of failure of commercial state-of-the-art float level switches include 1) moisture penetrating electrical connections and causing short circuiting; 2) cracking of the reed switch due to differences in thermal expansion of various components: 3) embrittlementor weaking of structural materials; 4) degradation of lead wire insulation by chemicals, high radiation, high temperature, or moisture.

The sealing of moisture from electrical connections can be accomplished with heat shrinkable tubing, e.g., Larsson et al., U.S. Pat. No. 4,518,819; Reeder, U.S. Pat. No. 4,464,540; Bahder, U.S. Pat. No. 4,487,994; and Johnston et al., U.S. Pat. No. 3,984,912. The art does not teach the use of these sealing techniques in the design of float level switches.

Terhune et al., U.S. Pat. No. 4,521,373, discloses a liquid level sensor for a nuclear reactor which includes a sensing element having a positive temperature coefficient of electrical resistivity. The detector is driven by a constant current source of electricity and the presence of liquid is determined by resistance measurement. The sensing element is a multilayered coaxial cable. This device requires calibration and is far more expensive than a float level switch.

There are many liquid level detectors based on a float containing a magnetic portion that activates a reed switch. None of these inventions specifies materials that will tolerate the conditions in the containment vessel of a nuclear power plant during a loss of coolant accident, nor do the designs contemplate the special demands of high temperature, high pressure, and high radiation and the special sealing needs that these cause. The following inventions are typical.

Anderson et al., U.S. Pat. No. 4,748,300, discloses a liquid level indicator switch that closes a reed switch when a designated liquid level is reached. The device has a built-in time delay should the liquid level drop only temporarily.

Bachman, U.S. Pat. No. 4,142,079, discloses a float-level switch with a remotely operable lifting mechanism to permit checking of the operational status of the float.

Bongort et al., U.S. Pat. Nos. 4,056,979 and 4,056,979 disclose a liquid level sensor with a magnetic float and one or more reed switches that may be normally open, normally closed, or any combination, so that movement of the float past the switches produces any desired circuit sequence.

Bongort et al., U.S. Pat. No. 4,165,935, discloses a differential float control. As the magnet-containing float rises and falls with liquid level, a reed switch is activated and a controlling pump or the like maintains the liquid within prescribed limits.

Nakagawa, U.S. Pat. No. 4,020,481, discloses a fluid level alarm device that is activated by the closing of a reed switch when the float containing a magnetic portion falls below a certain level.

Other related inventions with various special features include: Jones, U.S. Pat. No. 3,751,614 (pull to test feature); Uemura, U.S. Pat. No. 4,037,193 (alarm apparatus for the tank of a vehicle); Nusbaum, U.S. Pat. No. 3,437,771 (two-element float with limited relative movement of the elements); and Dombrowski et al., U.S. Pat. No. 4,258,238 (signal transmitter with silicone rubber embedment).

Nuclear qualified components have been increasingly required in the design of nuclear power plants. Much of the instrumentation that has been developed is costly. Float switches are one of the least expensive and most reliable level sensing designs, but have been avoided in nuclear power plants because of the likelihood of failure with available designs.

The industry is lacking a float level switch that can withstand conditions in a containment vessel of a nuclear power plant during a loss of coolant accident.

SUMMARY OF THE INVENTION

This invention is a float level switch used to sense rise or fall in water level in a containment vessel of a nuclear power plant during a loss of coolant accident. The essential components of the device are a guide tube, a reed switch inside the guide tube, a float sliding on said guide tube, said float containing a magnetic portion that activates the reed switch, insulated conductors connecting the reed switch to a monitoring system outside the containment vessel. Special sealing and protecting means encase said conductors, the reed switch, and the connections between them, protecting the components from moisture and mechanical damage.

DESCRIPTION OF THE PREFERRED EMBODIMENT

Figure 1:
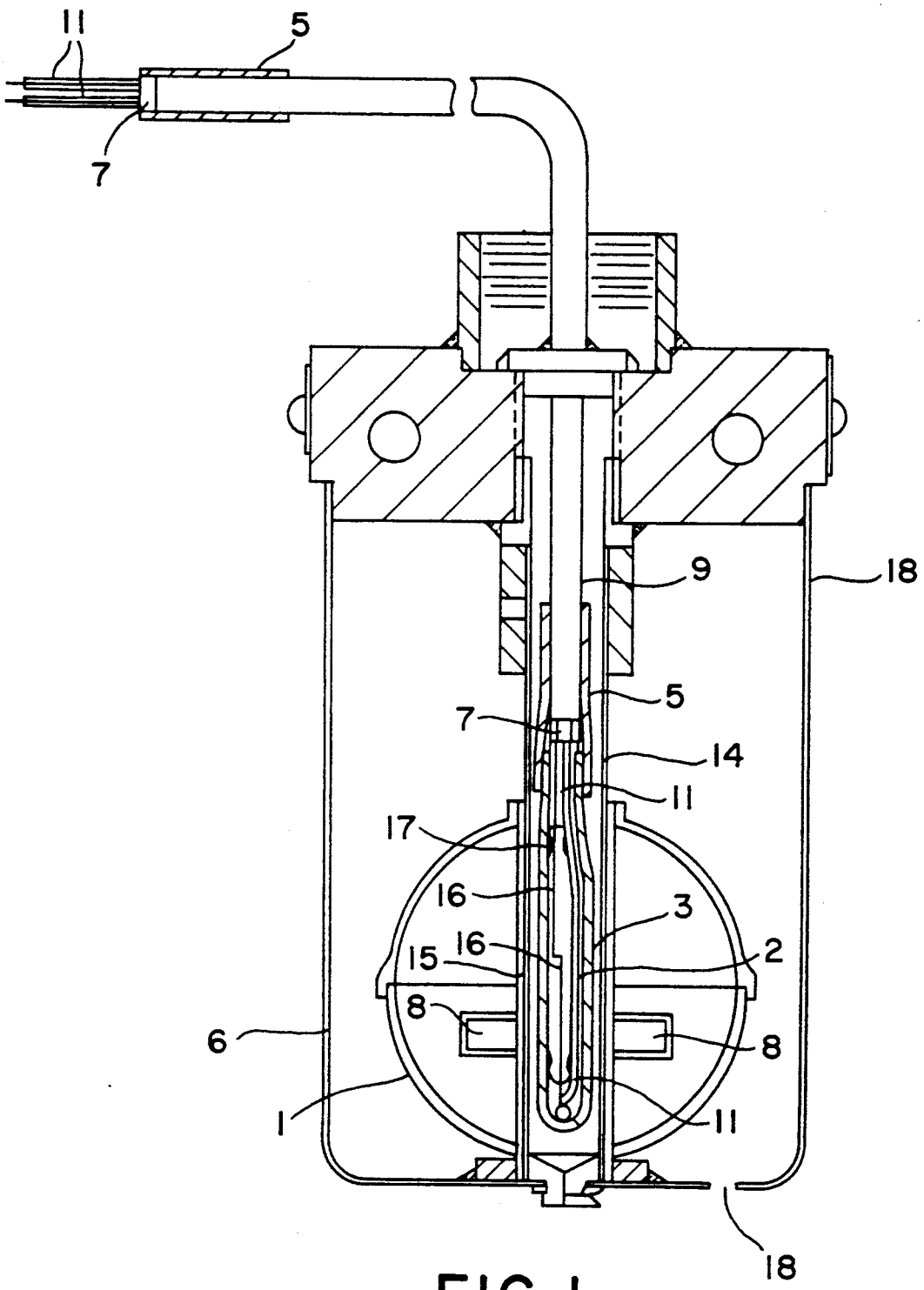
FIG. 1 is a longitudinal cross-section of the device.

This invention is a float level switch used to sense water level in a nuclear power plant containment vessel after a loss of coolant accident. IEEE Standard 323-1974 is used to qualify the switch. Tests included Radiation Aging, Thermal Aging, Mechanical Cycling, Seismic Testing, Extreme Environment Testing, and Loss of Coolant Accident Testing. The device will withstand conditions in the containment vessel of a naval nuclear power plant (about 520 deg. F, 160 psig, and 365,000,000 rads), as well as milder conditions in a commercial nuclear power plant.

The float level switch comprises a float which rides up and down a guide tube as the water level changes in the containment vessel. The float has a magnetic portion, and when water reaches a predetermined level, the magnet opens a normally closed reed switch, thereby activating an alarm located outside of the containment vessel. Structural materials of the switch are made of nuclear-qualified 304 CRES stainless steel.

FIG. 1 discloses a longitudinal cross section of a nuclear-qualified float level switch. Inside the guide tube 14 is a reed switch 15. The reed switch has two elongated, magnetizable, electrically conducting contacts 16 contained in a housing 17 made of insulating material (preferably; glass). The contacts overlap a small fraction of their length when closed and are normally open. When a magnet of appropriate polarity comes into proximity with the contacts, i.e., the float is in the lowest position, the contacts close and remain closed. When the float is raised along the guide tube by the rising water level, the magnet releases the reed switch contacts, causing them to open.

Water reaches float 1 by passing through perforations 18 in shield 6. Preferably, the perforations in the shield are sufficient in number and size to allow water to pass quickly. The ring-shaped magnet 8 is internally mounted in the float so that the magnetic field is roughly parallel to the axis of the guide tube and the reed switch. As the float rises to a point corresponding with a certain water level, the magnet releases the reed switch and the contacts open.

The two ends of the reed switch have leads that are each connected to conductors 2 that extend beyond the metal sheathing 9 insulated with polyolefin, polyimide, or fiberglass tubing 11. The two conductors, insulated with ceramic material and surrounded by a metal sheathing, together constitute a two-conductor cable. Desirably, the conductors are copper and the insulation can tolerate conditions of high temperature and high radiation. Desirably, the sheathing is of nuclear-qualified stainless steel; preferably, it is flexible.

The reed switch and insulated conductors are encased in a flexible polymer 3 that is overlapped with another flexible polymer 5 that will withstand conditions of high temperature, high pressure, high moisture, and high radiation that would occur in a containment vessel of a nuclear power plant or similar harsh environment. The polymers seal from moisture and electrically insulate the reed switch and cable conductors from the guide tube. A desirable polymer would be a soft silicone compound. Others would be fiberglass, polyolefin, or polyimide. Preferably, the polymer that encases the reed switch is a heat-shrink polymer sleeve with a closed end made of polyolefin. A commercially available product for making an encased reed switch is the Raychem NESK End Sealing Kit. Differences in the coefficient of thermal expansion of the encasing polymer, the reed switch, and the guide tube are taken into account to avoid cracking the reed switch at high temperatures. Allowance can be made either in the selection of materials or in allowing sufficient clearance between the bottom of the guide tube and the material encasing the reed switch.

It is desirable to prevent moisture and pressure from entering the area inside the guide tube 14. This is accomplished by welding or brazing 20 the 2-conductor cable metal sheathing 9 into the end of the guide tube 21. It is also desirable to secure the two conductors at the end of the metal sheathing with a two-hole ceramic bead 7. The bead, in conjunction with sleeve 5, will align the two conductors and preclude shorting of the conductors on the cable sheathing.

The end of the two-conductor cable opposite the float switch is connected to alarm equipment located outside of the containment vessel or spliced and sealed to another cable inside the containment vessel. The end of the cable is prepared for connection by insulating each of the conductors with polyolefin, polyimide, or fiberglass tubing 11. It is also desirable to secure the two conductors at the end of the metal sheathing with a two-hole ceramic bead 7. This bead, in conjunction with sleeve 5, will align the two conductors and preclude shorting of the conductors on the cable sheathing.

What is claimed is:

1. A nuclear qualified float level switch that can functions reliably inside a nuclear containment vessel in a harsh environment consisting of elevated temperature and pressure, a high level of ambient moisture, and heavy radiation dose, said nuclear qualified float level switch comprising:

a) a reed switch with an exterior lead at each of its ends;

b) two electrically insulated, mechanically protected conductors, each having a switch end connected to a lead of said reed switch and an alarm end located outside the containment vessel;

c) a plurality of sealing and protecting means encasing said conductors, the reed switch, and the connections between them, wherein said plurality of sealing and protecting means seal out moisture and protect the components from mechanical damage, said plurality of sealing and protecting means of the two electrically insulated, mechanically protected conductors comprising at least mineral insulation encasing said conductors and stainless steel sheathing around said mineral insulated conductors;

d) a guide tube containing:

said reed switch, its leads, said connections thereto, and the switch ends of said two insulated conductors; and said sealing and protecting means for said reed switch and its connections; and e) a float surrounding said guide tube, said float containing a magnetic portion that causes said reed switch to be activated when said float reaches a predetermined level corresponding to a certain water level.

2. The nuclear qualified float level switch of claim 1 wherein the conductors are copper.

3. The nuclear qualified float level switch of claim 1 wherein the sealing and protecting means of the connections and the reed switch is heat shrink or other sleeves.

4. The nuclear qualified float level switch of claim 1 wherein a mechanically protective shield for said nuclear qualified float switch completely surrounds said nuclear qualified float switch with a mechanically rigid enclosure to protect the float, said shield having perforations that allow the rapid passage of surrounding fluid.

5. The nuclear qualified float level switch of claim 1 wherein said stainless steel sheathing is welded or brazed to one end of said guide tube so as to pressure-seal said guide tube and so as to preclude the entry of moisture inside the guide tube.

* * * * *